US009205851B2

(12) United States Patent
Yoshimoto et al.

(10) Patent No.: US 9,205,851 B2
(45) Date of Patent: Dec. 8, 2015

(54) SPEED PROFILE CREATION DEVICE AND AUTOMATIC TRAIN OPERATION APPARATUS

(75) Inventors: Koki Yoshimoto, Tokyo (JP); Satoru Takahashi, Tokyo (JP); Kenji Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/350,431

(22) PCT Filed: Feb. 29, 2012

(86) PCT No.: PCT/JP2012/055017
§ 371 (c)(1),
(2), (4) Date: Apr. 8, 2014

(87) PCT Pub. No.: WO2013/057969
PCT Pub. Date: Apr. 25, 2013

(65) Prior Publication Data

US 2014/0222259 A1 Aug. 7, 2014

(30) Foreign Application Priority Data

Oct. 19, 2011 (JP) ..... 2011-229795

(51) Int. Cl.
*G05D 1/00* (2006.01)
*B61L 27/00* (2006.01)

(52) U.S. Cl.
CPC ..... *B61L 27/0027* (2013.01)

(58) Field of Classification Search
None
See application file for complete search history.

(56) References Cited

U.S. PATENT DOCUMENTS 7,343,314 B2 * 3/2008 Matheson et al. ..... 701/19
7,917,345 B2 * 3/2011 Hawthorne ..... 703/8

(Continued)

FOREIGN PATENT DOCUMENTS

JP 4 287766 10/1992
JP 5 193502 8/1993

(Continued)

OTHER PUBLICATIONS

International Search Report Issued Jun. 5, 2012 in PCT/JP12/055017 Filed Feb. 29, 2012.

(Continued)

*Primary Examiner* — Calvin Cheung
(74) *Attorney, Agent, or Firm* — Oblon, McClelland, Maier & Neustadt, L.L.P.

(57) ABSTRACT

A speed profile creation device includes: a traveling simulator that creates, from a traveling instruction, a speed profile of allowing the train to travel through a traveling section together with a traveling time and energy consumption amount thereof by using a route condition, train performance, and a traveling condition; a traveling instruction draft creator that creates a plurality of traveling instruction drafts in which a reference speed profile is changed so that the energy consumption amount can decrease though the traveling time is lengthened a little; an optimum speed profile selector that selects an optimum speed profile in which an energy consumption amount reduction effect is maximum among the plurality of traveling instruction drafts; and a reference speed profile updating unit that updates the reference speed profile until the traveling time of the optimum speed profile becomes equivalent to the target traveling time.

13 Claims, 15 Drawing Sheets

(56) References Cited

U.S. PATENT DOCUMENTS

| | | | | |
|---|---|---|---|---|
| 8,082,071 | B2 * | 12/2011 | Daum | B61L 27/0027 701/1 |
| 2007/0219682 | A1 * | 9/2007 | Kumar et al. | 701/19 |
| 2012/0197466 | A1 | 8/2012 | Yoshimoto et al. | |
| 2014/0088865 | A1 * | 3/2014 | Thies | G06Q 10/04 701/465 |

FOREIGN PATENT DOCUMENTS

| | | |
|---|---|---|
| JP | 6 284519 | 10/1994 |
| JP | 7-327302 | 12/1995 |
| JP | 2858529 | 2/1999 |
| JP | 2004-155314 | 6/2004 |
| JP | 3881302 | 2/2007 |
| JP | 2009-177908 | 8/2009 |
| JP | 2010 228688 | 10/2010 |
| JP | 2010-246304 | 10/2010 |
| WO | WO 2011/086629 A1 | 7/2011 |

OTHER PUBLICATIONS

International Preliminary Report on Patentability issued May 1, 2014 in PCT/JP2012/055017 (with English translation).

International Preliminary Report on Patentability and Written Opinion issued Aug. 7, 2014 in PCT/JP2012/055017 (English translation only).

Japanese Office Action issued Oct. 21, 2014, in Japan Patent Application No. 2013-539546 (with English translation).

* cited by examiner

F I G . 5

| TRAVELING INSTRUCTION DRAFT | SECTION | CONDITION |
|---|---|---|
| 1 | 11650～12000 | COASTING |
| 2 | 11670～10900 | COASTING |
| 3 | 10470～10700 | COASTING |
| 4 | 10000～10900 | MAXIMUM SPEED SUPPRESSION (69 km/h) |
| 5 | 11400～12000 | MAXIMUM SPEED SUPPRESSION (59 km/h) |

F I G . 6

| TRAVELING INSTRUCTION DRAFT | TRAVELING TIME SCHEDULE | ELECTRIC POWER CONSUMPTION AMOUNT | EVALUATION INDEX e |
|---|---|---|---|
| (REFERENCE SPEED PROFILE) | (154.0 SECONDS) | (9.0kWh) | —— |
| 1 | 154.3 SECONDS | 8.7kWh | 1.00 (SELECTED) |
| 2 | 154.5 SECONDS | 8.8kWh | 0.40 |
| 3 | 154.4 SECONDS | 8.8kWh | 0.50 |
| 4 | 154.6 SECONDS | 8.8kWh | 0.33 |
| 5 | 154.9 SECONDS | 8.9kWh | 0.11 |

F I G . 8

| SECTION | CONDITION |
|---|---|
| 11650～12000 | COASTING |

F I G . 9

| TRAVELING INSTRUCTION DRAFT | SECTION | CONDITION |
|---|---|---|
| 1 | 11650～12000 | COASTING |
| | 10470～10700 | COASTING |
| 2 | 11650～12000 | COASTING |
| | 10670～10900 | COASTING |
| 3 | 11650～12000 | COASTING |
| | 11620～11650 | COASTING |
| 4 | 10650～12000 | COASTING |
| | 10000～10900 | MAXIMUM SPEED SUPPRESSION (69 km/h) |
| 5 | 11650～12000 | COASTING |
| | 11400～12000 | MAXIMUM SPEED SUPPRESSION (59 km/h) |

| | TRAVELING TIME SCHEDULE | ELECTRIC POWER CONSUMPTION AMOUNT |
|---|---|---|
| M | 193 SECONDS | 7.1kWh |
| L | 193 SECONDS | 6.7kWh |

SPEED PROFILE CREATION DEVICE AND AUTOMATIC TRAIN OPERATION APPARATUS

TECHNICAL FIELD

The present invention relates to a speed profile creation device that creates a speed profile represented by a speed and acceleration/deceleration state of a train for each position, and to an automatic train operation apparatus that automatically operates the train.

BACKGROUND ART

In general, a speed profile of a train is created on a desk by a designer based on an empirical rule, and accordingly, performance of the speed profile, such as an energy consumption amount and riding comfort, depends on the designer, and has not necessarily been optimized. Moreover, the speed profile is designed in off-line, and accordingly, in a case where an allowance time is shortened by a disruption to train services during service, and in a case where an acceleration/deceleration speed according to designed performance cannot be exerted because passengers are many, traveling that follows the speed profile has been impossible. A plurality of methods for solving such problems as described above and automatically creating an optimum speed profile are proposed.

There is proposed a method, in which, first, a speed profile that satisfies a target traveling time is created by a traveling simulator and upper limit speed setting means, and further, a speed profile that considers riding comfort and energy saving is created by notch switching parameter adjusting means (Patent Document 1).

Moreover, there is proposed a method, in which a speed profile of traveling between stations at a fastest speed is created by a simulator, is divided into a plurality of portions, and is added with a coasting section to the respective portions little by little, whereby a speed profile that satisfies a target traveling time is created (Patent Document 2).

It is known that, in a case where an inter-station traveling time is constant, a manner of traveling, in which an energy consumption amount of a train becomes minimum, generally takes a pattern changing in order of acceleration, constant speed, coasting and deceleration.

PRIOR ART DOCUMENT

Patent Document

Patent Document 1: Japanese Patent No. 3198170 (pp. 1-2, FIG. 1)

Patent Document 2: Japanese Patent No. 3881302 (pp. 1-2, FIG. 8)

SUMMARY OF INVENTION

Problems to be Solved by the Invention

In Patent Document 1, a speed profile in which a maximum speed is first adjusted and only the target traveling time is considered is created and the adjustment for improving the energy consumption amount and the riding comfort is performed based on the plan. In this method, since the maximum speed is first determined, a search range is limited, and accordingly, the maximum speed is prone to fall into a solution lower than in an ideal pattern in which the energy consumption amount becomes minimum, and the reduction of the energy consumption amount is insufficient. Moreover, the reduction of the energy consumption amount is insufficient also from the point that the coasting is not considered.

Moreover, in the method of Patent Document 2, the adjustment of the energy consumption and the traveling time is performed by the coasting; however, an adjustment of a speed in constant-speed traveling is not considered. Therefore, in the case where the target traveling time is sufficiently large and an inter-station distance is long, in the method of Patent Document 2, there is a case of creating a speed profile for stopping the train between stations. Moreover, places where the coasting sections are added are limited to vicinities of braking start points.

The present invention has been made in order to solve the problems as described above, and an object of the present invention is to provide a speed profile creation device capable of creating a speed profile in which the target traveling time is kept and the energy consumption amount is small.

Moreover, another object of the present invention is to provide an automatic train operation apparatus capable of automatically running a train so that the target traveling time is kept and the energy consumption amount decreases.

Means for Solving the Problems

A speed profile creation device according to the present invention includes: a storage that holds a route condition, train performance, and a traveling condition at least including a traveling section and a target traveling time, the traveling section and the target traveling time being as objects of a speed profile to be created; a traveling simulator that creates, from a traveling instruction, a speed profile of traveling through the traveling section together with a traveling time and energy consumption amount of the speed profile by using the route condition, the train performance, and the traveling condition, which are held in the storage; an initial speed profile setter that sets an initial value for a reference speed profile; a traveling instruction draft creator that creates, from a reference traveling instruction corresponding to the reference speed profile, a plurality of traveling instruction drafts in which the reference traveling instruction is changed so that the energy consumption amount decreases though the traveling time is lengthened; a simulation starter that creates, by using the traveling simulator, a plurality of the speed profiles individually corresponding to the plurality of traveling instruction drafts; an optimum speed profile selector that selects an optimum speed profile as the speed profile, in which an energy consumption amount reduction effect becomes maximum among the plurality of speed profiles with respect to the reference speed profile; an evaluator that determines whether or not a traveling time of the optimum speed profile is in a predetermined time range including the target traveling time; an output unit that, in a case where the traveling time is in the predetermined time range, outputs either or both of the optimum speed profile and a traveling instruction corresponding to the optimum speed profile; a reference speed profile updating unit that sets the optimum speed profile as the reference speed profile in a case where the traveling time of the optimum speed profile is smaller than a lower limit value of the predetermined time range; and a traveling instruction draft creation starter that starts the traveling instruction draft creator in a case where the reference speed profile is set.

An automatic train operation apparatus according to the present invention includes the speed profile creation device; a current position acquisition unit that specifies current train position and speed; a current speed limit acquisition unit that acquires a current speed limit as a speed limit at present from an ATC device; and a traveling instruction arithmetic operation unit that, for the traveling condition in which a traveling section determined from the current train position is set, starts the speed profile creation device, and creates a traveling instruction to allow the train to travel in accordance with the created speed profile and the current speed limit.

Effects of the Invention

In accordance with the speed profile creation device according to the present invention, the speed profile, in which the target traveling time is kept and the energy consumption amount is small, can be created.

In accordance with the automatic train operation apparatus according to the present invention, the train can be automatically run so that the target traveling time is kept and the energy consumption amount decreases.

Objects, features, aspects and advantages of the present invention will be more apparent by the following detailed description and the accompanying drawings.

BRIEF DESCRIPTION OF DRAWINGS

FIG. 5 is a view showing an example of a traveling instruction draft created by the speed profile creation device according to Embodiment 1 of the present invention.

FIG. 6 is a view showing an example of an evaluation index value calculated by the speed profile creation device according to Embodiment 1 of the present invention.

FIG. 8 is a view showing an example of a traveling instruction created by the speed profile creation device according to Embodiment 1 of the present invention.

FIG. 9 is a view explaining the traveling instruction draft created by the speed profile creation device according to Embodiment 1 of the present invention, by another example.

DESCRIPTION OF EMBODIMENTS

Embodiment 1.

Figure 1:
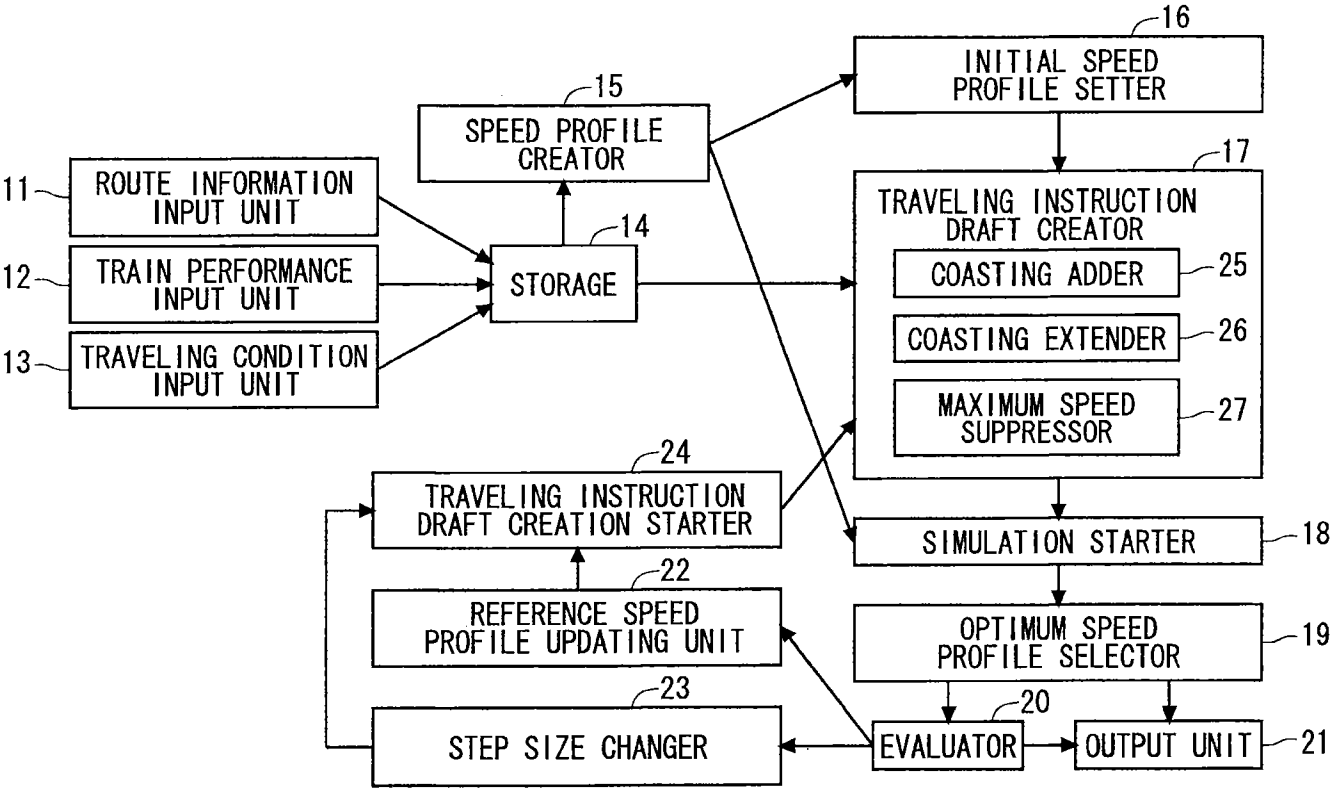
FIG. 1 is a block diagram showing a configuration of a speed profile creation device according to Embodiment 1 of the present invention.

FIG. 1 is a block diagram showing a configuration of a speed profile creation device according to Embodiment 1 of the present invention. In the following drawings, those added with the same reference numerals are the same or similar elements, and this matter is applied to the whole text of this specification. Furthermore, forms of constituent elements described in the whole text of the specification are merely illustrations, and the present invention is not limited to a description.

With reference to FIG. 1, a description is made of the configuration of the speed profile creation device according to Embodiment 1. The speed profile creation device includes: route information input unit 11; a train performance input unit 12; a traveling condition input unit 13; a storage 14; a speed profile creator 15; initial speed profile setter 16; a traveling instruction draft creator 17; a simulation starter 18; an optimum speed profile selector 19; an evaluator 20; an output unit 21; a reference speed profile updating unit 22; a step size changer 23; and a traveling instruction draft creation starter 24.

The route information input unit 11 receives input of route conditions as data regarding a route along which a train travels, the data including gradients, positions of curves, curvature radii thereof, speed limits, and the like. The train performance input unit 12 receives input of train performance as data regarding a train, the data including a train weight, a train length, acceleration performance, deceleration performance, air resistance, motor efficiency and the like. Note that a single car is also a train. The traveling condition input unit 13 receives input of traveling conditions as data and the like of information regarding a start point and end point of a traveling section as an objective section for which a speed profile is to be created, regarding a target traveling time between both of the points, and regarding temporal speed limits set in sections included in the traveling section. Note that the target traveling time is generally represented by a value obtained by subtracting an allowance time from an inter-station traveling time on a train schedule. In a case of creating a speed profile to be used for a train automatic operation, the target traveling time may be set appropriately in response to a degree of the disruption to train services.

The route conditions inputted by the route information input unit 11, the train performance inputted by the train performance input unit 12 and the traveling conditions inputted by the traveling condition input unit 13 are held in a storage 14 so that other processing units can refer thereto.

In this embodiment, the route information input unit 11, the train performance input unit 12 and the traveling condition input unit 13 are provided; however, these units may not have to be provided. The present invention can be carried out if the present invention has the storage 14 which holds the route conditions, the train performance, and the traveling conditions at least including a target traveling section and a target traveling time for which the speed profile is to be created. Any one or two input units among the route information input unit 11, the train performance input unit 12 and the traveling condition input unit 13 may be provided.

In consideration of the route conditions such as the gradient and of the train performance, by using the route conditions, the train performance and the traveling conditions, which are held in the storage 14, a speed profile creator 15 as a traveling simulator creates, through the simulation, a speed profile of traveling from a start position (start point) of a traveling section, which is designated by the traveling conditions, to a stop target position (end point) in a time as short as possible, together with a traveling time and energy consumption amount thereof. In this embodiment, the train is an object, and accordingly, there is also a case where the energy consumption amount is also written as an electric power consumption amount. Even in the case of generating power by an internal combustion engine such as a diesel engine, necessary data such as a fuel consumption is stored as train performance thereof in the storage 14, and the speed profile creator 15 creates the speed profile by using those data.

The traveling instruction refers to an instruction regarding a traveling method in which the energy consumption amount decreases, the traveling method being determined for each certain section (for example, a section as designated from a position P1 to a position P2) in the traveling section. An aggregate of the traveling instructions is also referred to as a traveling instruction. In this embodiment, a single traveling instruction designates coasting in a certain section, or suppresses a maximum speed in the certain section to be smaller than an original maximum speed. The speed profile represents a relationship between a position and speed of a train in the case of traveling along a designated traveling instruction. Note that, even in a section where the coasting is instructed, priority is given to deceleration in the case where the deceleration is necessary in order to keep the speed limit and stop at a stop target position.

In this embodiment, there is iterated an operation of first obtaining a fastest speed profile of traveling through the traveling section fastest, and correcting the speed profile so that the energy consumption amount can decrease gradually though the traveling time is lengthened. Each time in the iteration, the speed profile before being corrected is referred to as a reference speed profile. In a state where the traveling instruction is not present at all, the initial speed profile setter 16 executes the speed profile creator 15 to obtain the fastest speed profile, and sets the obtained fastest speed profile as an initial value of the reference speed profile.

From a reference traveling instruction corresponding to the reference speed profile, the traveling instruction draft creator 17 creates a plurality of traveling instruction drafts in which a part of the reference traveling instruction is changed so that the energy consumption amount decreases though the traveling time is lengthened. The traveling instruction draft creator 17 includes: a coasting adder 25 that newly adds a single coasting section to a section that is not the coasting section in the reference traveling instruction; a coasting extender 26 that lengthens the single coasting section, which is included in the reference traveling instruction, to a side closer to the start position of the traveling section; and a maximum speed suppressor 27 that sets the maximum speed in the certain section to be smaller than a value in the reference traveling instruction. Note that, in a section where the traveling instruction that suppresses the maximum speed is not present in the reference traveling instruction, a maximum speed obtained from the speed limit according to a rule to be described later is defined as the maximum speed by the reference traveling instruction in the section.

A description is briefly made of a reason why the energy consumption amount can be reduced by adding or extending the coasting section or lowering the maximum speed. The coasting is a state where power is not used for traveling. On a level ground, a speed of the train that is coasting is gradually lowered by air resistance, friction between wheels and rails, and the like. In constant-speed sections on the level ground and an upward gradient, the power is used so that the speed cannot be lowered, and accordingly, when the constant-speed sections are changed to the coasting sections, the energy consumption amount can be reduced. When the maximum speed is lowered, an energy consumption amount required for the acceleration to the maximum speed can be reduced.

The simulation starter 18 gives, one by one, the speed profile creator 15 the respective pieces of the plurality of traveling instruction drafts created by the traveling instruction draft creator 17, and creates the speed profiles. The created speed profiles are managed so as to correspond to the traveling instruction drafts. Note that, in the speed profile creator 15, together with each of the speed profiles, a traveling time and an electric power consumption amount in the speed profile are also obtained.

The optimum speed profile selector 19 selects, as an optimum speed profile, a pattern in which an energy consumption amount reduction effect (described later) is the largest among the plurality of speed profiles created by the simulation starter 18 with respect to the reference speed profile.

The evaluator 20 evaluates whether or not a traveling time of the optimum speed profile is in a predetermined time range including the target traveling time. In the case where the target traveling time is given while having a width, a range defined as the target traveling time is the predetermined time range including the target traveling time. In the case where the target traveling time is a single value, a range from a time shorter by a predetermined time to a time longer by a predetermined time, the range including the target traveling time, is defined as a predetermined time range in consideration of a magnitude of an error of the traveling time, which is allowed in the running of the train, a calculation error, and the like. Here, the predetermined time on a side on which the time is shortened and the predetermined time on a side on which the time is lengthened may be the same or different.

In the case where the traveling time of the optimum speed profile is equal to or more than a lower limit value and is equal to or less than an upper limit value of the predetermined time range including the target traveling time, the evaluator 20 determines that the traveling time of the optimum speed profile is in the predetermined time range. Otherwise, the evaluator 20 determines that the traveling time of the optimum speed profile is not in the predetermined time range.

In the case where the traveling time of the optimum speed profile is in the predetermined time range including the target traveling time, the output unit 21 outputs, to an outside, either or both of the optimum speed profile and the traveling instruction corresponding thereto. The optimum speed profile or the traveling instruction, which is to be outputted, is the speed profile created by this speed profile creation device.

The reference speed profile updating unit 22 sets the optimum speed profile as the reference speed profile so that the optimum speed profile can be further changed to obtain the speed profile.

The step size changer 23 changes a step size for determining a magnitude of a change of the reference traveling instruction in the event where the traveling instruction draft creator 17 changes a part of the reference traveling instruction to create the traveling instruction draft.

In the case where the reference speed profile is set, or in the case where the step size is changed by the step size changer 23, the traveling instruction draft creation starter 24 starts the traveling instruction draft creator 17.

Figure 2:
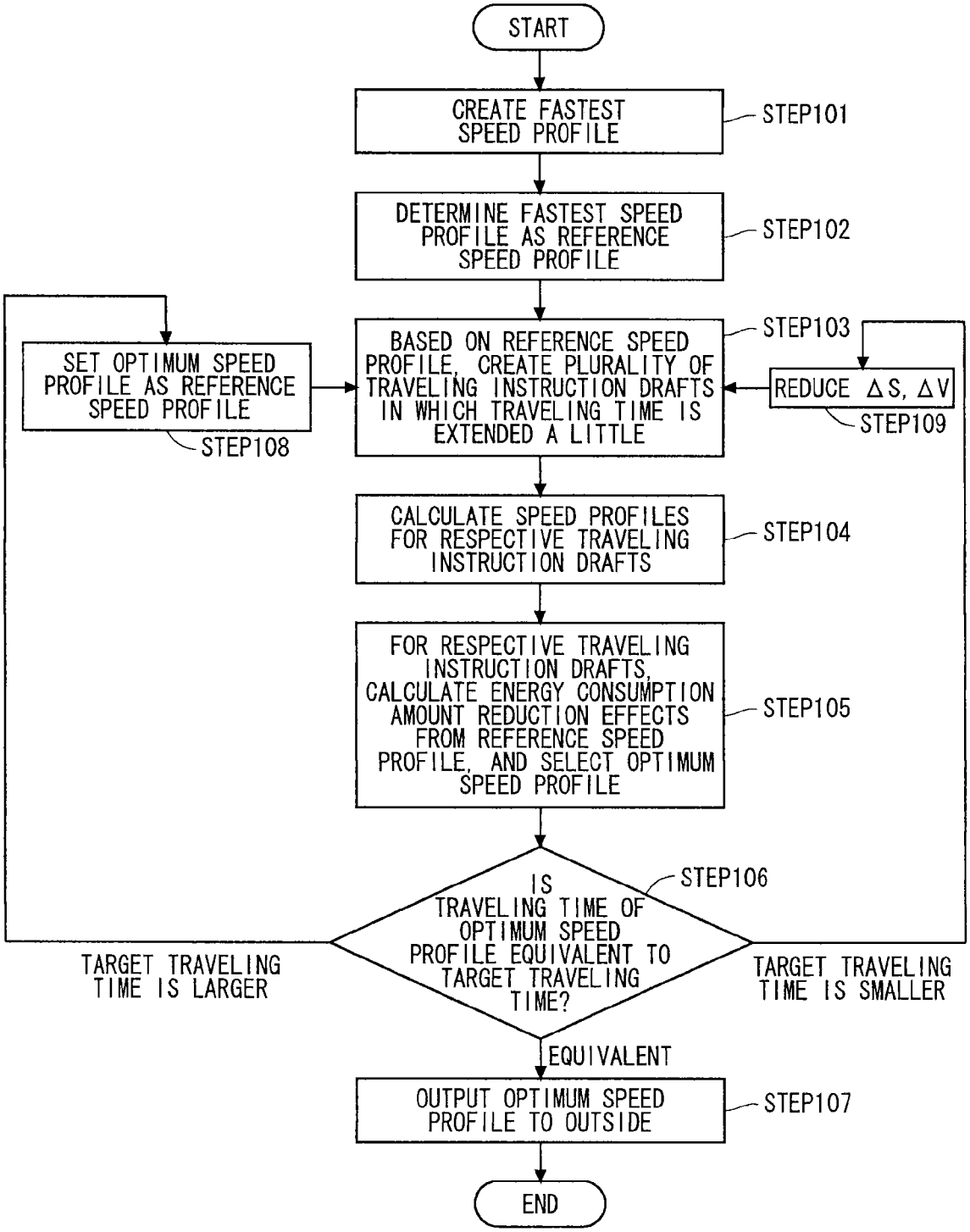
FIG. 2 is a flowchart explaining processing for creating a speed profile by the speed profile creation device according to Embodiment 1 of the present invention.

Next, with reference to a flowchart of FIG. 2, a description is made of detailed operations in the event where the speed profile creation device of Embodiment 1 creates the speed profile. FIG. 2 is a flowchart explaining processing for creating the speed profile by the speed profile creation device according to Embodiment 1 of the present invention.

First, the initial speed profile setter 16 executes the speed profile creator 15 in the state where the traveling section is not present at all, creates the fastest speed profile of traveling from the start point of the traveling section to the end point thereof fastest, and calculates the traveling time and electric power consumption amount thereof (STEP 101). Note that speeds at the start point and the end point are also designated, and the fastest speed profile is obtained. In the case where intervals between stations at which the train stops are defined as traveling sections, the speeds at the start point and the end point become zero. In the case where a station through which the train passes becomes the start point or the end point, a speed at a point corresponding to the station through which the train passes becomes a designated speed that is not zero.

Figure 3:
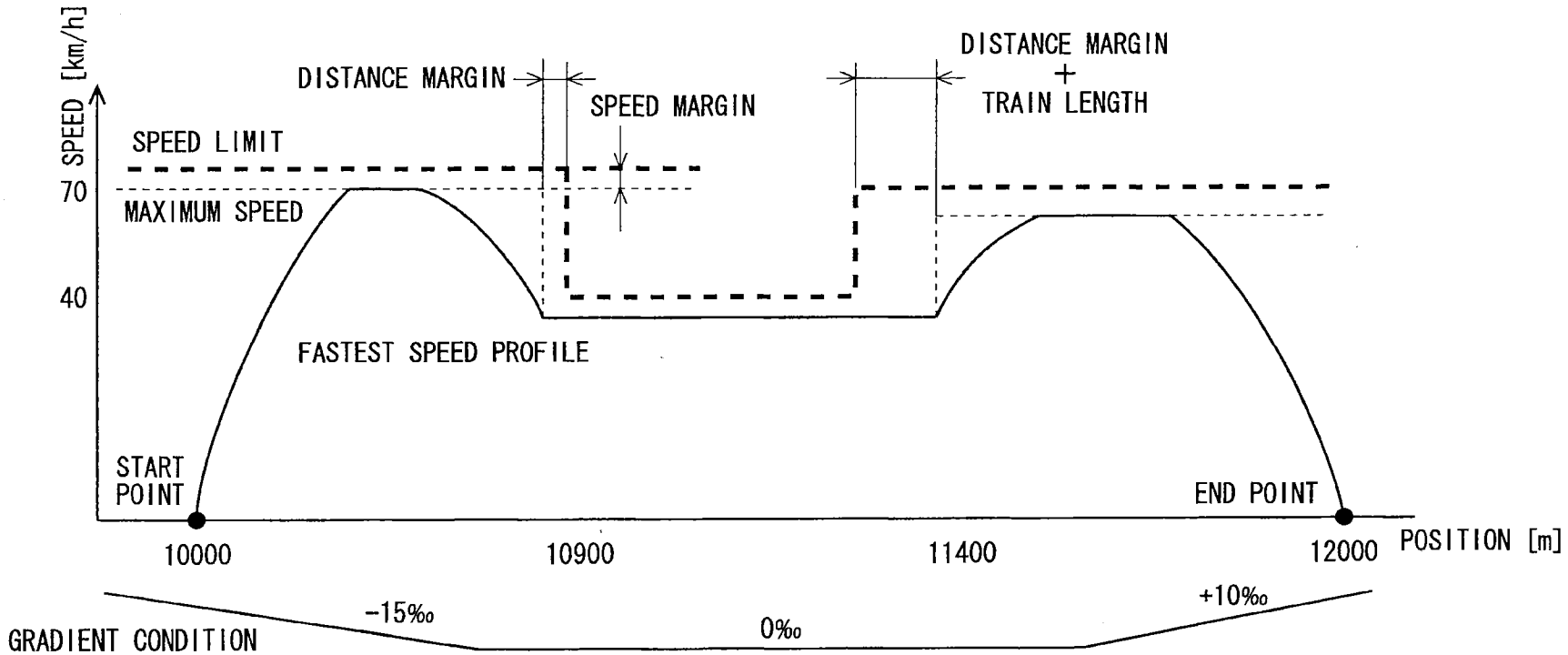
FIG. 3 is a view explaining, by an example, a fastest speed profile of traveling through a traveling section fastest, and in addition, explaining a relationship between a speed limit and a maximum speed.

FIG. 3 is a view explaining, by an example, the fastest speed profile of traveling through the traveling section fastest, and in addition, explaining a relationship between the speed limit and the maximum speed. In FIG. 3, an axis of ordinates is a train speed, and an axis of abscissas is a distance from a reference point. The reference point is determined at an appropriate position for each route. The speed profile can be expressed by a combination of sections of four types of modes, which are: an acceleration mode; a constant-speed mode; a coasting mode; and a deceleration mode.

FIG. 3 also shows the relationship between the speed limit and the maximum speed, and accordingly, a description is made of the rule for obtaining the maximum speed from the speed limit. In general, the train travels at a speed lower by a fixed amount of a speed margin with respect to the speed limit, and accordingly, the maximum speed becomes smaller than the speed limit by the amount of the speed margin. At a point where the speed limit is changed to be low, from a point ahead of that point by a distance margin, a speed obtained by subtracting the speed margin from a low speed limit in the following section is defined as a maximum speed. At a point where the speed limit is changed to be high, the acceleration is possible after a tail end of the train passes over the point and further passes through a distance margin, and accordingly, to a distance in which the point is passed through and the distance margin is added to a length of the train, the maximum speed in the previous section is maintained.

Such a conversion from the speed limit into the maximum speed is performed by the speed profile creator 15. The maximum speed may be obtained in advance, and may be given as the traveling instruction in the event of obtaining the fastest speed profile.

Note that the speed limit stands for a smaller speed between a speed limit in the route conditions and a temporal speed limit in the traveling conditions.

Next, this fastest speed profile is determined as the reference speed profile to be used for creating the traveling instruction draft by the traveling instruction draft creator 17. Moreover, a state where no traveling instruction is present is determined as the reference traveling instruction (STEP 102).

Next, upon detecting that the reference speed profile is set, the traveling instruction draft creation starter 24 starts the traveling instruction draft creator 17. By changing a part of the traveling instructions or by making a change by adding new traveling instructions based on the reference traveling instruction, the traveling instruction draft creator 17 creates a plurality of traveling instruction drafts, in which the traveling time is expected to become a little longer than the reference speed profile, and the energy consumption amount is expected to decrease (STEP 103).

Figure 4:
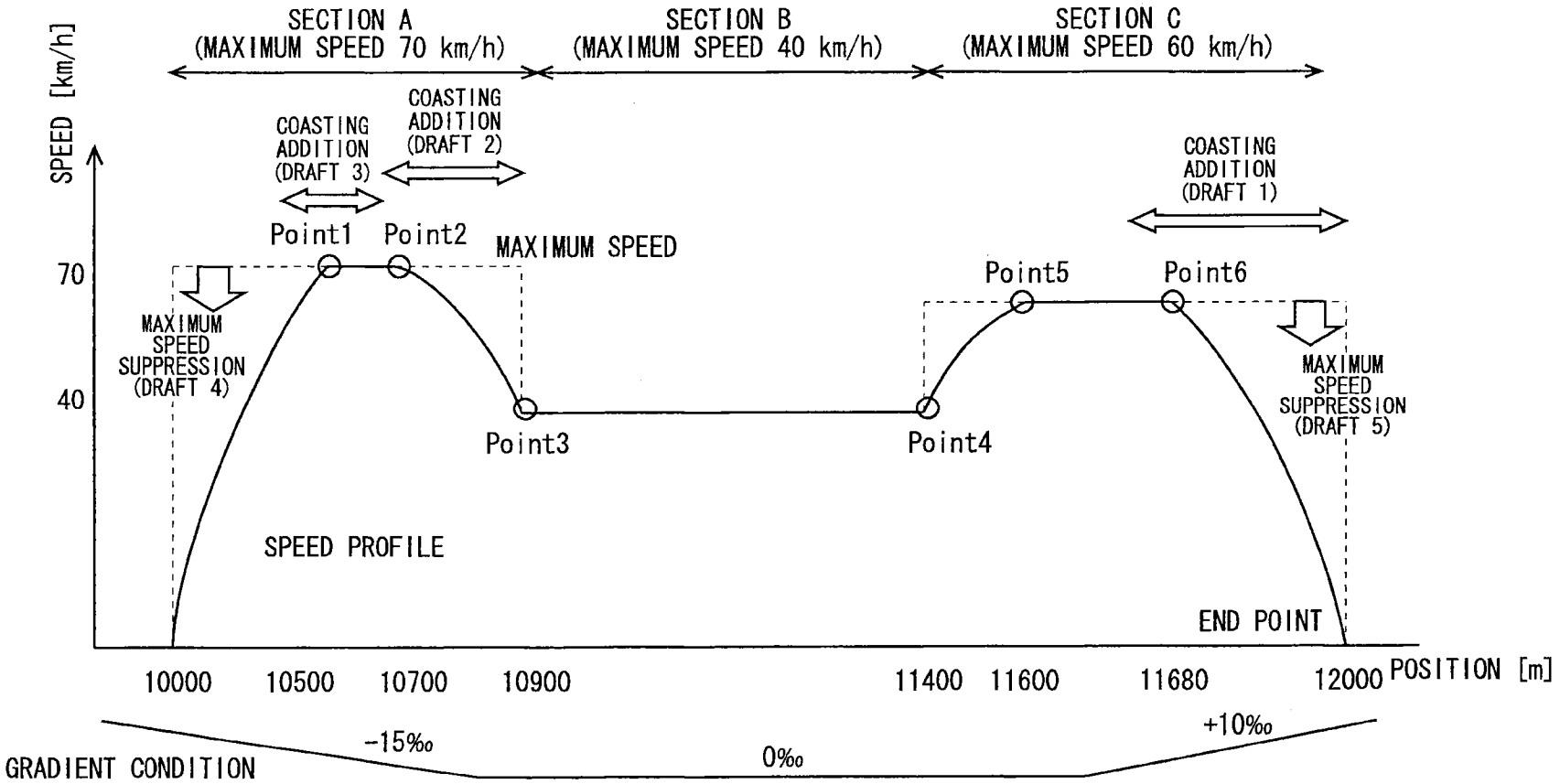
FIG. 4 is a view explaining a proposed change of a traveling instruction, which is created by the speed profile creation device according to Embodiment 1 of the present invention, by an example.

With reference to FIG. 4, FIG. 5 and FIG. 7 to FIG. 9, a description is made of how to create the traveling instruction drafts by the speed profile creation device according to the present invention. FIG. 4 is a view explaining a proposed change of the traveling instruction, which is created by the speed profile creation device according to Embodiment 1 of the present invention, by an example. FIG. 5 shows traveling instruction drafts created from the reference speed profile shown in FIG. 4. Note that the reference speed profile of FIG. 4 is the fastest speed profile, and nothing is set in the reference traveling instruction. The traveling instruction drafts 1 to 5 of FIG. 5 correspond to drafts 1 to 5 of FIG. 4, respectively.

Figure 7:
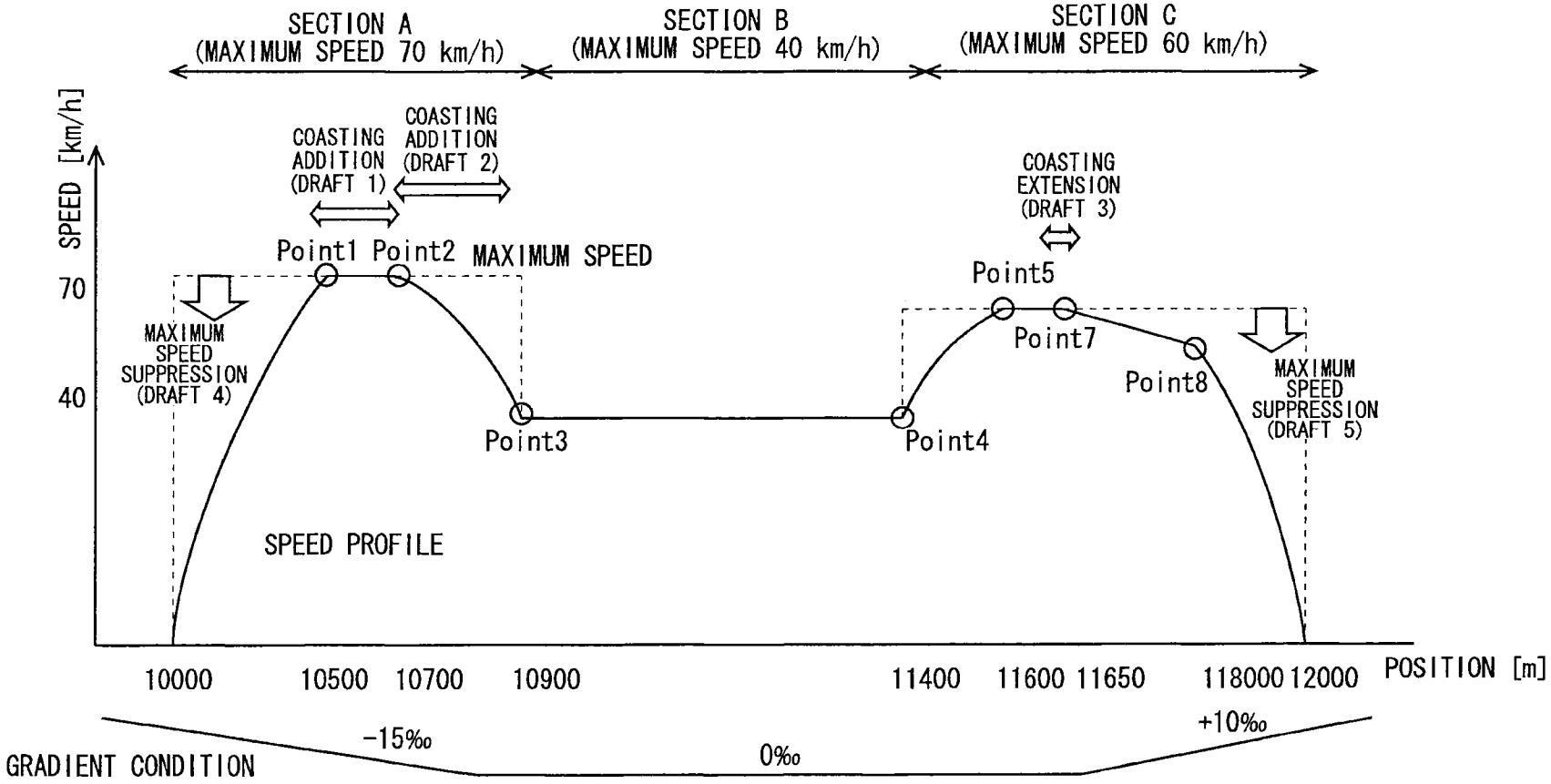
FIG. 7 is a view explaining the proposed change of the traveling instruction, which is created by the speed profile creation device according to Embodiment 1 of the present invention, by another example.

Moreover, FIG. 7 shows a view explaining a traveling instruction draft to be created from the reference speed profile changed in accordance with the draft 1 of FIG. 5 as a result that the draft 1 is selected as will be described later. FIG. 8 shows a reference traveling instruction at the point of time when the traveling instruction draft of FIG. 7 is created. The reference traveling instruction shown in FIG. 8 is the draft 1 of FIG. 5. FIG. 9 shows traveling instruction drafts created from the reference speed profile shown in FIG. 7. In FIG. 9, upper stages are the reference traveling instructions already determined by first loop processing, and lower stages are the newly added traveling instructions. The traveling instruction drafts 1 to 5 of FIG. 9 correspond to drafts 1 to 5 of FIG. 7, respectively.

The traveling instruction draft creator 17 has the coasting adder 25, the coasting extender 26, and the maximum speed suppressor 27. A description is made of a method in which the respective processing units create the traveling instruction drafts.

(1) Processing by Coasting Adder 25

The coasting sections are added to spots which apply to any of coasting adding rules shown below.

Coasting adding rule 1: To each switching point from the constant speed to the deceleration, the coasting section is added from a point on this side thereof by a distance ΔS1. The draft 1 and the draft 2, which are shown in FIG. 4, and the draft 2 shown in FIG. 7 are traveling instruction drafts to be created by the coasting adding rule 1.

Coasting adding rule 2: To each switching point from the acceleration to the deceleration, the coasting section is added from a point on this side thereof by a distance ΔS2.

Coasting adding rule 3: To each switching point from the acceleration to the constant speed, which is located in a downward gradient in which an absolute value of the gradient is equal to or more than a predetermined value (for example, 10 per mil), the coasting section is added from a point on this side thereof by a distance ΔS3. Here, the downward gradient in which the absolute value of the gradient is the predetermined value or more is referred to as a "steep downward gradient". The draft 3 shown in FIG. 4 and the draft 1 shown in FIG. 7 are traveling instruction drafts to be created by the coasting adding rule 3. The predetermined value for determining the steep downward gradient is determined so as to become equal to or more than a magnitude of a downward gradient at which the acceleration is enabled by the coasting.

The respective values of ΔS1, ΔS2 and ΔS3, which are described above, are set at 30 m for example.

In the coasting adding rule 3, in order that the acceleration is enabled from the beginning of the coasting section, it is necessary that a gradient of a section from the end point of the acceleration section to a point on this side thereof by a predetermined distance be the steep downward gradient. The predetermined distance is determined as appropriate in consideration of the train length. Note that the end point of the acceleration section is also the start point of the coasting section. Moreover, in order that necessary acceleration is enabled by the coasting, it is necessary that a gradient of a section from the end point of the acceleration section to a point subsequent thereto by a predetermined distance be also a steep downward gradient. The predetermined distance is determined as appropriate in consideration of a speed difference between speeds before and after acceleration in the acceleration section of the distance ΔS3 before the section is changed to the coasting section. In the case where the gradient is changed in the section, it is recommended that an average gradient therein is determined as a gradient of the section. The gradient of the section may be obtained by another obtaining method such as a median.

Note that, in the coasting adding rule 1 and the coasting adding rule 2, the end point of the coasting section is set as a switching point of the maximum speed, which is located forward of each switching point. In the coasting adding rule 3, the end point of the coasting section is set as an end point of the downward gradient, which is located forward of each switching point. Alternatively, for each of the rules, a point located forward of each switching point by a distance predetermined times (for example, five times) ΔSn (n=1, 2, 3) may be set as the end point of the coasting section.

(2) Processing by Coasting Extender 26

The coasting section in the reference traveling instruction is changed (extended) so that the start point thereof can be a point on this side thereof by a distance ΔS4. The draft 3 shown in FIG. 7 is a traveling instruction draft to be created by the coasting extender 26.

A value of ΔS4 is set, for example, at 30 m. By which rule the coasting section to be extended is added may be considered, and ΔS4 may be set at a different value in response to the rule. In a coasting section located on the steep downward gradient, it may be checked whether or not a gradient of a section up to a point on this side of the extended coasting section by a predetermined distance applies the steep downward gradient, and in the case where the gradient of the section does not apply thereto, a length of the coasting section to be extended may be shortened so that the gradient can apply thereto.

(3) Processing by Maximum Speed Suppressor 27

As shown in FIG. 4 and FIG. 7, the sections are divided for each of turning points of the maximum speed (sections A, B and C). Here, sections on sides of the start point and the end point, which do not include the traveling sections (that is, the sides are outsides of the traveling sections), are handled on the assumption that the maximum speed is zero. Here, a section in which the maximum speed protrudes downward, that is, a section in which the maximum speed is higher than in sections adjacent thereto on both sides is selected as a maximum speed suppression section. Then, a value in which the maximum speed in that section is lowered by ΔV is designated as a new maximum speed in that section. ΔV is set, for example, to 1 km/h.

Note that, in the case where a plurality of the coasting sections overlap or continue with each other since a loop for changing the reference speed profile is passed by many times, these may be integrated into one. Moreover, in the case where the maximum speed coincides with the maximum speed in the adjacent section as a result of the maximum speed suppression, these are merged into one section.

Next, the simulation starter 18 gives the speed profile creator 15 the respective pieces of the plurality of traveling instruction drafts one by one, creates the speed profiles, and calculates the traveling time and energy consumption amount of each thereof (STEP 104).

Next, for the respective speed profiles, the optimum speed profile selector 19 calculates evaluation indices e, which represent energy consumption amount reduction effects compared with the reference speed profile, and selects a optimum speed profile (STEP 105).

The evaluation indices e are determined, for example, as in Expression (1).

[Expression 1]

$$e = \frac{-(E_n - E_0)}{(T_n - T_0)} \tag{1}$$

In this Expression, $E_n$ denotes the energy consumption amount of the applicable speed profile, $E_0$ denotes the energy consumption amount of the reference speed profile, $T_n$ denotes the traveling time of the applicable speed profile, and $T_0$ denotes the traveling time of the reference speed profile. Expression (1) is an expression for calculating the energy consumption amount reduction effects. Such an energy consumption amount reduction effect is an index that expresses how much the energy consumption amount is lowered with respect to an increase of a unit amount of the traveling time. The larger the evaluation index e is, the more desirable the traveling instruction draft is.

Calculation results of the traveling time, the energy consumption amounts and the evaluation results e, which are calculated for the respective traveling instruction drafts shown in FIG. 5, are shown in FIG. 6. In the case of FIG. 6, when the evaluation indices e are compared with one another, the traveling instruction draft No. 1 is the largest, and accordingly, the optimum speed profile selector 19 selects as the optimum speed profile, the speed profile corresponding to the traveling instruction draft No. 1.

Next, the evaluator 20 compares the traveling time of the optimum speed profile with the target traveling time held in the storage 14 (STEP 106).

In the case where the traveling time of the optimum speed profile is in the predetermined time range including the target traveling time, the optimum speed profile at that point of time is a final result, and accordingly, the output unit 21 outputs either or both of the optimum speed profile and the traveling instruction corresponding to said optimum speed profile (STEP 107), and the processing ends. Here, the case where the traveling time of the optimum speed profile is in the predetermined time range including the target traveling time will be referred to as "the traveling time of the optimum speed profile is equivalent to the target traveling time".

In the case where the traveling time of the optimum speed profile is not equivalent to the target traveling time, and the target traveling time is larger, that is, in the case where the traveling time of the optimum speed profile is smaller than the lower limit value of the predetermined time range of the target traveling time, the reference speed profile updating unit 22 sets the optimum speed profile as a new reference speed profile. Furthermore, the traveling instruction draft creation starter 24, which has detected that the reference speed profile is set, starts the traveling instruction draft creator 17, and the processing returns to STEP 103 (STEP 108).

In the case where the traveling time of the optimum speed profile is not equivalent to the target traveling time, and the target traveling time is smaller, that is, in the case where the traveling time of the optimum speed profile is larger than the upper limit value of the predetermined time range of the target traveling time, then the step size changer 23 reduces ΔSn and ΔV, which are the step sizes for determining the magnitude of the change of the reference traveling instruction in the event where the reference traveling instruction is changed to create the traveling instruction draft. Furthermore, the traveling instruction draft creation starter 24, which has detected that the step sizes are changed, starts the traveling instruction draft creator 17, and the processing returns to STEP 103 (STEP 109). This is processing for returning the traveling time to an origin thereof in the case where the traveling time exceeds the upper limit value of the predetermined time range of the target traveling time as a result that the addition of the coasting and the suppression of the maximum speed are performed excessively. Note that, if the step sizes are made sufficiently small from the beginning, the processing of STEP 109 and the step size changer are unnecessary.

Figure 10:
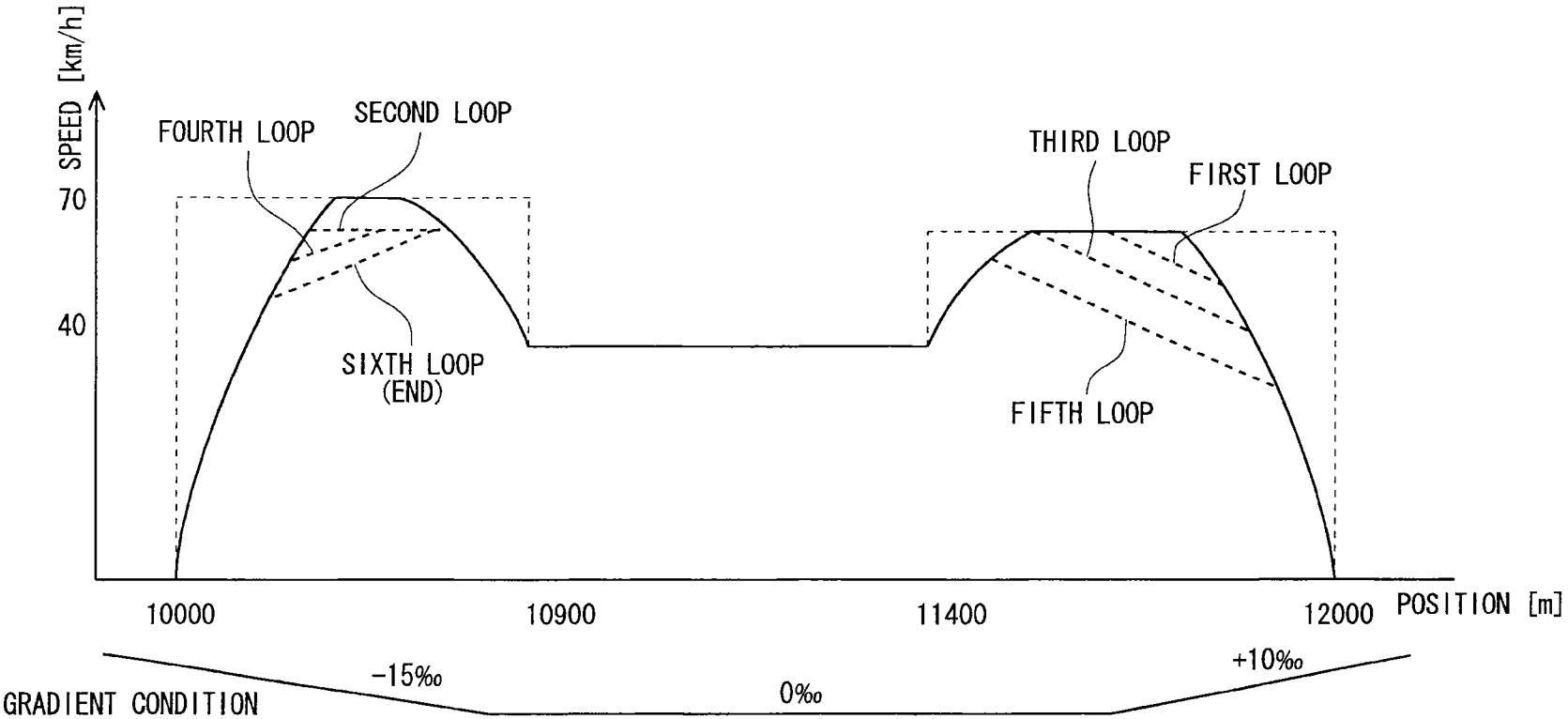
FIG. 10 is a view explaining a speed profile, which is created by iteration in the speed profile creation device according to Embodiment 1 of the present invention, by an example.

As described above, until the traveling time of the optimum speed profile becomes equivalent to the target traveling time, processing for setting the optimum speed profile in the previous loop as the reference speed profile is repeated. FIG. 10 shows one specific example of the loop processing at this time. FIG. 10 is a view explaining a speed profile, which is created by iteration in the speed profile creation device according to Embodiment 1 of the present invention, by an example.

In the first loop, the draft 1, in which the evaluation index e is the largest among the draft 1 to the draft 5, is employed based on FIG. 6 as mentioned above, and the speed profile corresponding to the draft 1 becomes a reference speed profile at the next time. Thereafter, passing through the second to fifth loops, the speed profile is determined at the sixth loop in which the traveling time of the optimum speed profile becomes equivalent to the target traveling time.

As described above, the processing loop is turned, and the traveling instruction draft, in which the energy consumption amount reduction effect is the largest each time of the loop, is employed, and accordingly, the energy consumption amount can be reduced as much as possible while approximating the traveling time to the target traveling time little by little. Such an operation that only a suppression amount of the maximum speed is first determined so as to satisfy the target traveling time is avoided, and accordingly, the maximum speed is avoided being set too low. As a result, while satisfying the target traveling time, such a speed profile in which the energy consumption amount becomes small can be calculated. Moreover, also in such a case where there is sufficient room for the target traveling time, and the train stops on the way of the traveling section only by the processing for adding the coasting section, such a speed profile can be created, in which the maximum speed is lowered appropriately, the train is allowed not to be stopped on the way of the traveling section, the target traveling time is satisfied, and the energy consumption amount is small.

Moreover, it is also considered that the acceleration is made by the coasting on the steep downward gradient, and accordingly, the energy consumption amount reduction effect can be made larger than in the case where the acceleration by the coasting on the steep downward gradient is not considered.

Figure 11:
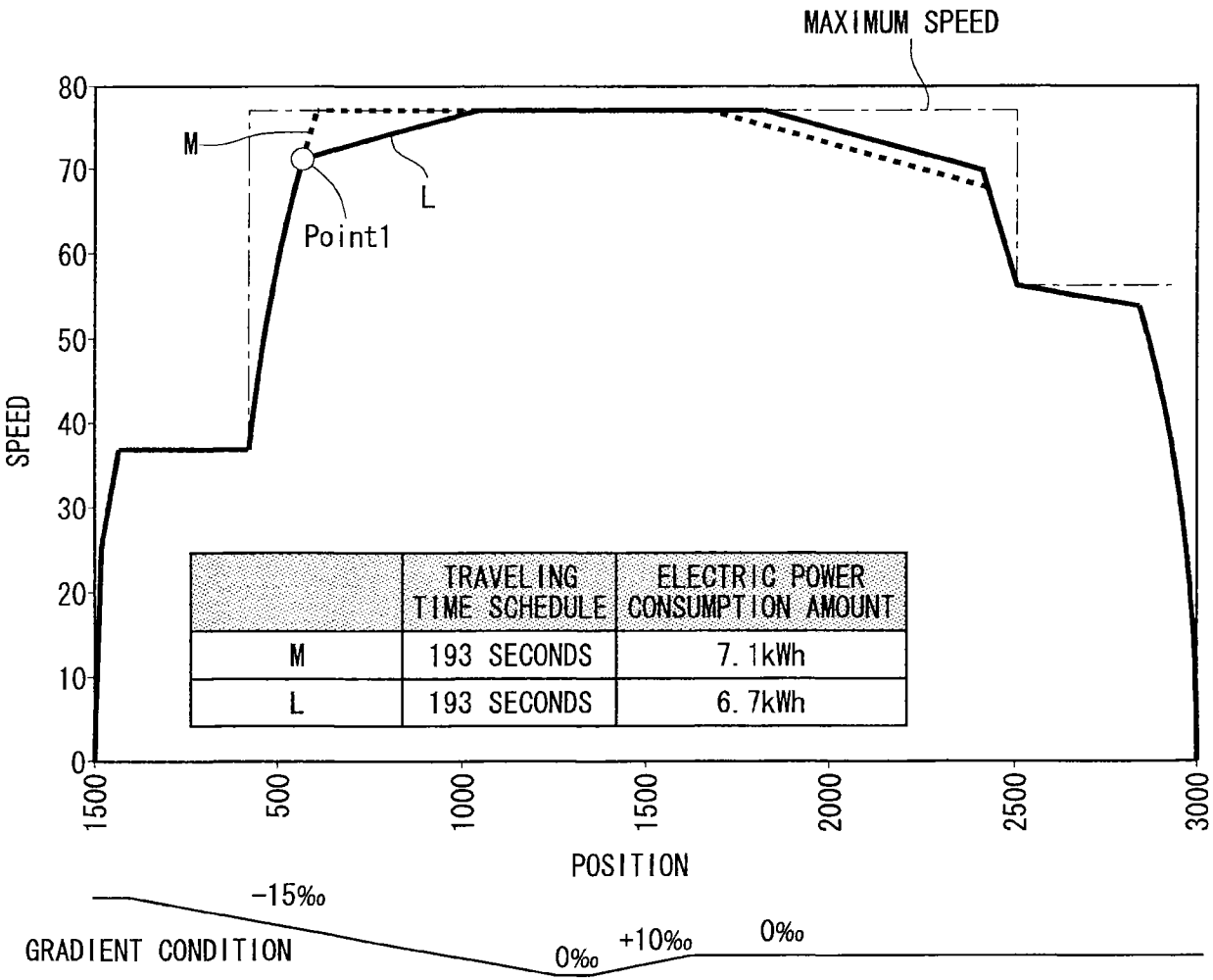
FIG. 11 is a view explaining, by an example, a reduction effect of an energy consumption amount by setting a coasting section into a section with a steep downward gradient in the speed profile creation device according to Embodiment 1 of the present invention.

FIG. 11 is a view explaining, by an example, the reduction effect of the energy consumption amount by setting the coasting section in each section with the steep downward gradient in the speed profile creation device according to Embodiment 1 of the present invention. A curve L of FIG. 11 shows a speed profile to be obtained in the case of suppressing the maximum speed, and in addition, setting the coasting on this side of a deceleration start point and in a steep downward gradient section. A curve M of FIG. 11 shows a speed profile to be obtained in the case of suppressing the maximum speed, and in addition, setting the coasting only on this side of the deceleration start point.

In the curve L, on the downward gradient, the acceleration is made from Point 1 by the coasting. In comparison with the curve M, the curve L is short in an acceleration section by powering and a constant-speed section subsequent thereto. An energy consumption amount in the case of the curve L is 6.7 kWh, and is lower than 7.1 kWh in the case of the curve M. It is also considered to make the coasting on the steep downward gradient as described above, whereby a speed profile in which the energy consumption amount is smaller can be made in comparison with the case where it is not considered to make the coasting.

Note that, in a route where the steep downward gradient is not present, the acceleration by the coasting on the steep downward gradient (coasting adding rule 3) may be set so as not to be considered.

Note that, as values of the step sizes ΔSn and ΔV are being made smaller, accuracy of the speed profile is enhanced; however, an arithmetic operation time is increased. Therefore, the values are adjusted in response to an arithmetic operation target time, required accuracy and specifications of a CPU in the speed profile creation device.

Note that, in the above example, the speed is set to zero individually at the start point and end point of the traveling section; however, the speed does not have to be zero. In this way, a speed profile, in which a target passage time in the case where a next station is a non-stop station is kept, can be created. At the time of running the train, a speed profile to the next station can also be created from a position and speed of the train at that point of time.

Figure 12:
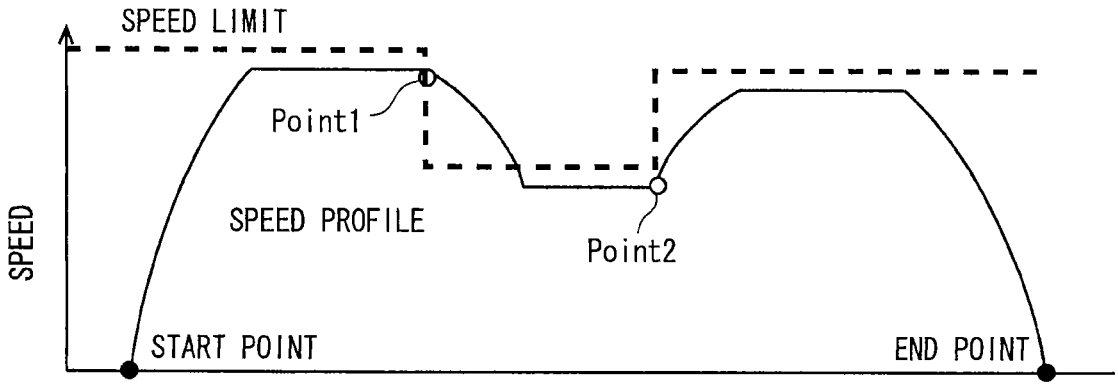
FIG. 12 is a view explaining, by an example, a relationship between the speed limit and the speed profile in a route that employs an analog ATC.

Moreover, in FIG. 3 and the like, it is premised that the train speed is slowed down before entering the section where the speed limit is lowered. Meanwhile, in a route that employs an analog ATC (Automatic Train Control) in a safety signal system, if a speed limit at that point is given from a ground side via rails, and the train speed exceeds the speed limit at the time of having received that information, then the deceleration is made until the train speed becomes equal to or less than a speed lower than the speed limit by the margin amount. FIG. 12 is a view explaining, by an example, a relationship between the speed limit and the speed profile in the route that employs the analog ATC.

In the speed profile in the route that employs the analog ATC, the deceleration is started after the train speed exceeds the speed limit. Hence, the deceleration is allowed to be started after the train speed exceeds the speed limit at Point 1 of FIG. 12, at which the speed limit is lowered. That is to say, the speed profile is created on the premise that the train speed temporarily exceeds the speed limit. With regard to the acceleration, such a speed profile, in which the acceleration is made from Point 2 at which the speed limit becomes high, is created.

The speed profile creation device shown in this embodiment is also applicable to such a route that employs the analog ATC.

Note that, in place of first creating the fastest speed profile and setting it as the initial value of the reference speed profile, a speed profile prepared in advance may be set as the initial value of the reference speed profile. In this way, the number of arithmetic operation loop times can be reduced, and the arithmetic operation time can be shortened. In that case, the traveling instruction may also be prepared in advance, or a traveling instruction corresponding thereto may be obtained from the prepared speed profile. Moreover, a traveling instruction is given, the given traveling instruction is simulated to obtain a speed profile, and the obtained speed profile may be set as the initial value of the reference speed profile.

In this embodiment, as the traveling instruction, the addition or extension of the coasting section and the suppression of the maximum speed are considered. Such a traveling instruction that changes the speed profile at the time of the acceleration or the time of the deceleration may also be considered.

Desirably, the step size for determining the magnitude of the change of the traveling instruction, the step size being used in the event of creating the traveling instruction draft, is determined so that increments of the traveling time in the respective traveling instruction drafts can be substantially the same. A reason for this is that the number of repetitions becomes substantially the same no matter which instruction draft may be selected. For this purpose, the step size is determined for each rule for changing the traveling instruction draft; however, the step size may be changed for each spot to which the rule is applied. With respect to the traveling instruction draft, the speed profile and the traveling time thereof are calculated, and accordingly, in a traveling instruction draft in which the increment of the traveling time with respect to the reference speed profile is too large or too small, the speed profile may be re-created by changing the step size to be small or to be large. The re-creation may be performed only for the selected traveling instruction draft, and may be performed for others from the next loop processing.

Moreover, in response to a difference between the traveling time of the optimum speed profile and the target traveling time in each turn of the loop processing, the step size may be set large in the case where the difference is large, and the step size may be set small in the case where the difference is small. In this way, in addition to that the required accuracy is satisfied, the number of repetitions of the loop, eventually, the arithmetic operation time can be shortened more than in the case where the step size is set constant at a small value from the beginning. For example, with respect to a residual time difference ratio as a value in which a difference (referred to as a residual time difference) between the traveling time of the fastest speed profile and the target traveling time in each turn of the loop processing (=residual time difference/initial time difference) is divided by a difference between the fastest speed profile and the target traveling time (referred to as an initial time difference), the step size may be determined as follows. (1) When the residual time difference ratio is less than 0.25, the step size is set equal to $\Delta$ (=$\Delta$), (2) when the residual time difference ratio is 0.25 or more and less than 0.5, the step size is set equal to $2\Delta$ (=$2\Delta$), and (3) when the residual time difference ratio is 0.5 or more, the step size is set equal to $4\Delta$ (=$4\Delta$). In this way, in comparison with the case where the step size is set to $\Delta$ from the beginning, substantially the same speed profile is obtained by approximately a half number of repetitions.

The evaluation index that selects the optimum speed profile may consider not only the energy consumption amount but also riding comfort.

For the train performance to be inputted to the train performance input unit 12, not a design value but a value assumed based on a traveling history in the past may be used. In this way, the case where the train performance is shifted from the design value and the case where the train performance is varied by a change with time can also be coped with appropriately. Moreover, train performance added with vehicle occupancy may be inputted.

In this embodiment, the processing units constituting the speed profile creation device are divided so that one processing unit can realize one function. A plurality of the functions may be realized by one processing unit. For example, the initial speed profile setter 16, the reference speed profile updating unit 22 and the step size changer 23 may start the traveling instruction draft creator 17. In that case, the traveling instruction draft creation starter 24 becomes unnecessary, and the function of the traveling instruction draft creation starter will also be realized by the initial speed profile setter, the reference speed profile updating unit and the step size changer. One processing unit may realize the functions of the optimum speed profile selector and the evaluator.

The route conditions, the train performance and the traveling conditions are individually inputted by using separate input units; however, may be inputted by using one input unit.

The above matter also applies to other embodiments.

Embodiment 2.

In Embodiment 1, in terms of creating the speed profile in which the target traveling time is kept, only the reduction of the energy consumption amount is considered; however, the riding comfort may be further considered. In this Embodiment 2, a description is made of a configuration of a speed profile creation device that creates the speed profile also in consideration of the riding comfort in addition to the reduction of the energy consumption amount.

Figure 13:
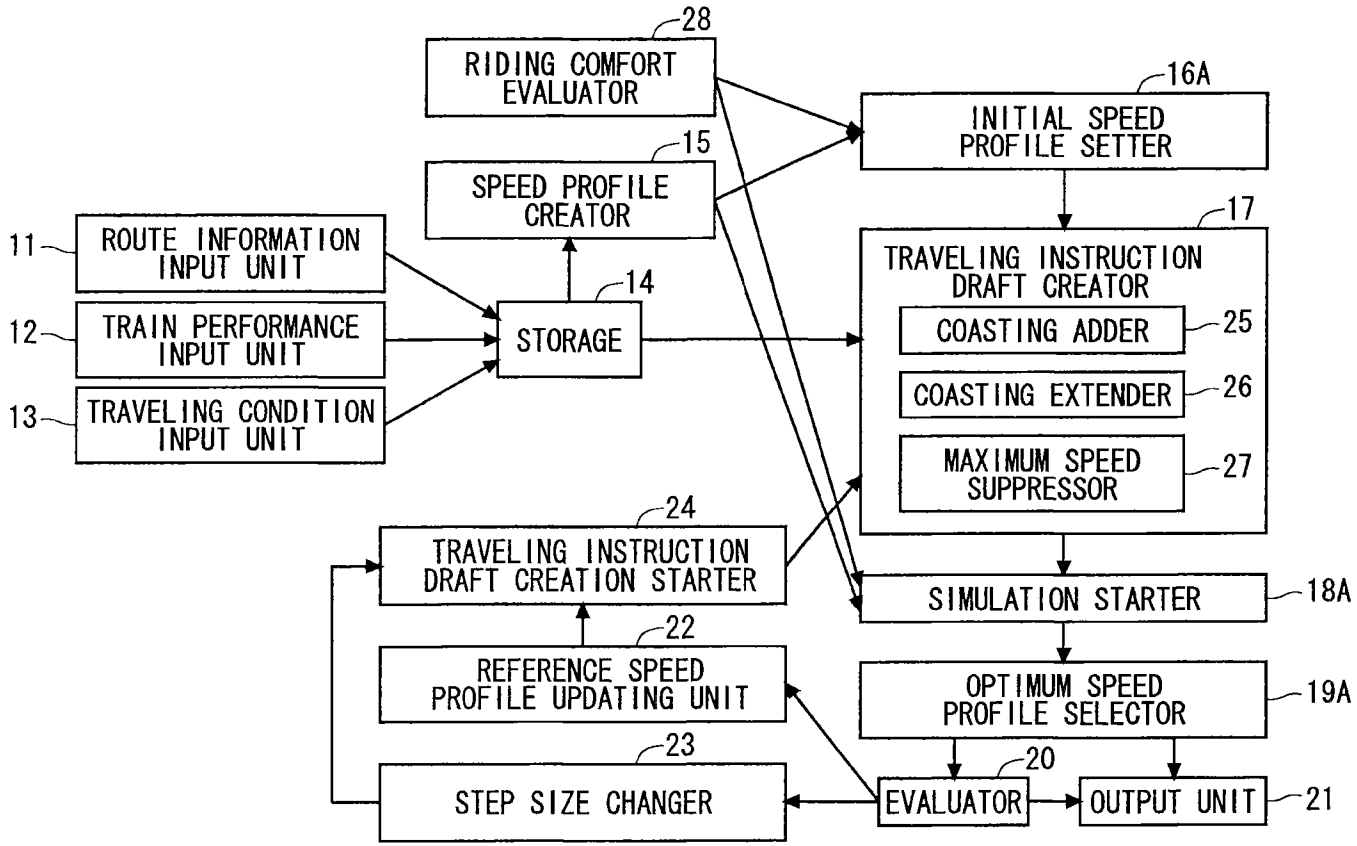
FIG. 13 is a block diagram showing a configuration of a speed profile creation device according to Embodiment 2 of the present invention.

FIG. 13 shows a block diagram explaining the configuration of the speed profile creation device according to Embodiment 2. In comparison with Embodiment 1 shown in FIG. 1, a riding comfort evaluator 28 is added, and an initial speed profile setter 16A, a simulation starter 18A and an optimum speed profile selector 19A are changed. The riding comfort evaluator 28 evaluates riding comfort of the speed profile, and creates a riding comfort index value as an index value thereof. After starting the speed profile creator 15, the initial speed profile setter 16A and the simulation starter 18A apply the riding comfort evaluator 28 to the created speed profile, and create the riding comfort index value. Based on the riding comfort index value created by the riding comfort evaluator 28 and on the energy consumption amount reduction effect, the optimum speed profile selector 19A makes a judgment for these comprehensively, and selects the optimum speed profile.

Figure 14:
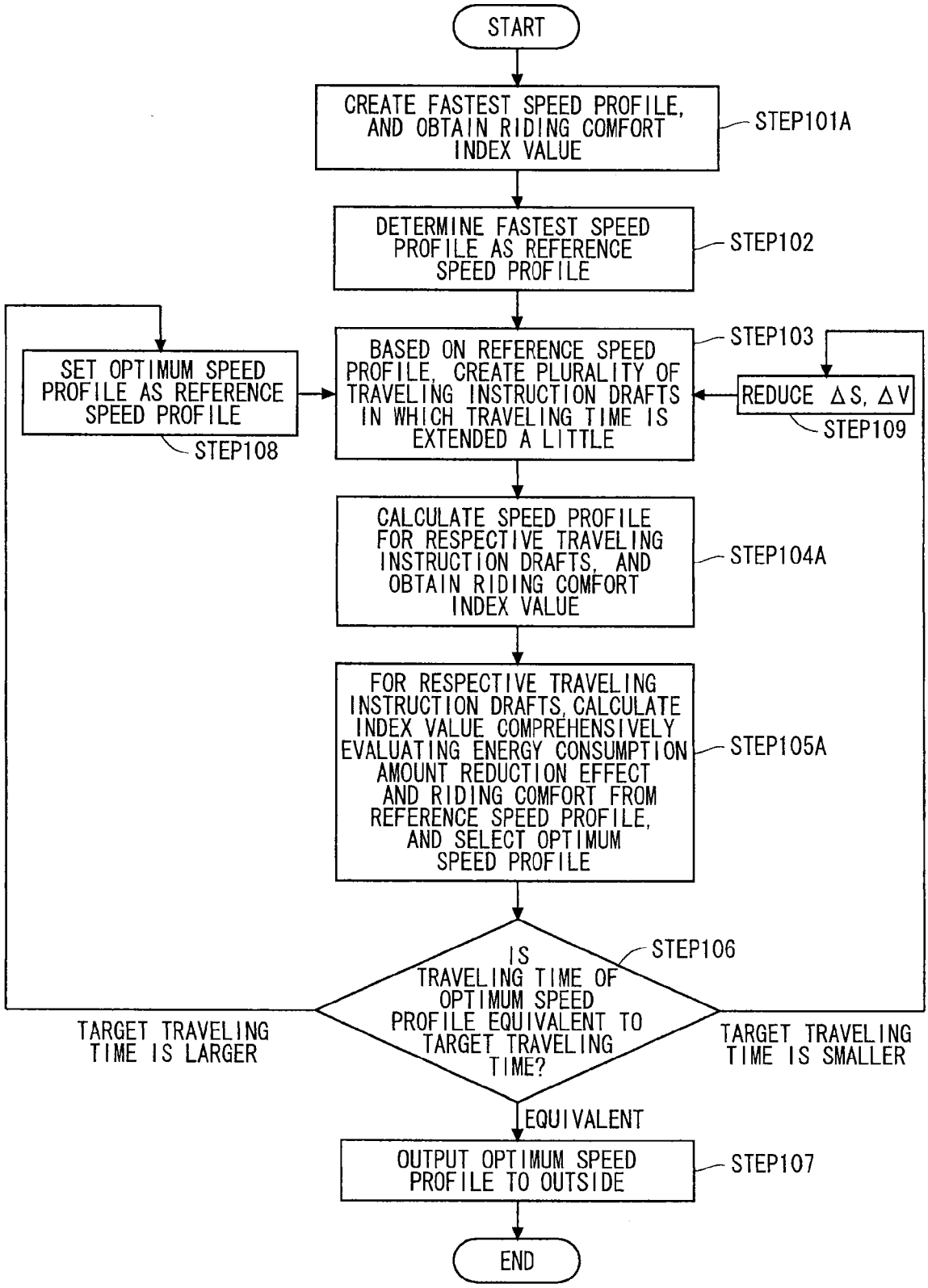
FIG. 14 is a flowchart explaining processing for creating the speed profile by the speed profile creation device according to Embodiment 2 of the present invention.

FIG. 14 shows a flowchart explaining processing for creating the speed profile by the speed profile creation device according to Embodiment 2 of the present invention. In comparison with Embodiment 1 shown in FIG. 2, operations of STEP 101A, STEP 104A and STEP 105A are changed.

The speed profile creator 15 may calculate the riding comfort index value. In that case, the speed profile creator is also the riding comfort evaluator.

In STEP 101A, for a fastest speed profile created by the initial speed profile setter 16A, the riding comfort evaluator 28 is started to obtain a riding comfort index value thereof. In STEP 104A, for each speed profile created by the speed profile creator 15, the simulation starter 18A starts the riding comfort evaluator 28 to obtain the riding comfort index value. Simply, the riding comfort index value can be calculated from the number of switching times of the traveling mode and the number of occurrences of jerks with a reference value or more. In this embodiment, the riding comfort index value is calculated from the number of mode switching times among the acceleration mode, the constant-speed mode, the traveling mode and the coasting mode.

In STEP 105A, an evaluation index value, which comprehensively evaluates the riding comfort index value and the energy consumption amount reduction effect, is calculated, and based on the evaluation index value, the optimum speed profile is selected.

In Embodiment 2, an evaluation index e2 for selecting the optimum speed profile is determined, for example, as in Expression (2).

[Expression 2]

$$e_2 = \frac{-(E_n - E_0)}{(T_n - T_0)} + \alpha\frac{1}{C_n} \tag{2}$$

Here, $C_n$ is the number of switching times of the traveling modes. $1/C_n$ is the riding comfort index value. The less the switching of the traveling mode is, the larger the riding comfort index value becomes. $\alpha$ is a coefficient that adjusts weighting of the energy saving and the riding comfort. The larger $\alpha$ is, the larger the weight of the riding comfort becomes. In STEP 105A, a speed profile, in which the evaluation index e2 expressed by Expression (2) becomes maximum, is selected as the optimum speed profile.

The evaluation index may be any one as long as being one that, based on the riding comfort index value and on the energy consumption amount reduction effect, makes a judgment for these comprehensively.

In accordance with the above-configuration, it is made possible to create a speed profile with good riding comfort while reducing the energy consumption amount.

Embodiment 3.

In Embodiments 1 and 2, in terms of creating the speed profile in which the target traveling time is kept, only the reduction of the energy consumption amount, or both of the reduction of the energy consumption amount and the riding comfort are considered; however, an influence onto a subsequent train may be further considered.

In the case where the train travels at a low speed immediately after departing from a station, which is the start point, for the purpose of the reduction of the energy consumption, it takes a time until this train completely comes out from the departure station (start point) and the subsequent train is enabled to arrive at the station. In such a case, the subsequent train is forced to be decelerated on this side of that station, and accordingly, there is a possibility to cause an increase of the energy consumption and a delay of the arrival at the station. In this Embodiment 3, a description is made of a configuration of a speed profile creation device that creates the speed profile also in consideration of an adverse effect to running of the subsequent train in addition to the reduction of the energy consumption amount.

The configuration of the speed profile creation device according to Embodiment 3 is similar to FIG. 3. However, an evaluation index to be used as the reference for selecting the optimum speed profile by the optimum speed profile selector 19A is different from Embodiments 1 and 2. In Embodiment 3, an evaluation index e3 for selecting the optimum speed profile can be determined, for example, as in Expression (3).

[Expression 3]

$$e_3 = \begin{cases} \dfrac{-\varepsilon(E_n - E_0)}{(T_n - T_0)} & \text{In the case where the distance between the start point of a newly added or changed traveling instruction and the departure point is lower than } D. \\ \dfrac{-(E_n - E_0)}{(T_n - T_0)} & \text{Other cases} \end{cases} \tag{3}$$

Here, D is a constant representing a distance from the departure station, at which the train can possibly affect the departure station. That is to say, if such a time from when the train departs from the station until when the train passes through a point at the distance D is not increased, then a delay is not caused on a time when the subsequent train can enter a platform of the station, and the running of the subsequent train is not affected. Saying on the contrary, if a time when the train passes through the point of the distance D is delayed since the train travels at a low speed immediately after departing from the station, then the subsequent train cannot enter the platform of the station on time, and the delay is caused on the running of the subsequent train.

For example, D is determined by a difference between a head position of the train at the point of time when a tail end of the train completely comes out from the platform of the departure station and a head position of the train at the point of time when the train is stopped at the departure station. This is an example of the case of assuming a signal system that permits entrance of the subsequent train to the platform if the tail end of the train completely comes out from the platform of the departure station (many signal systems employ this rule).

Moreover, $\epsilon$ is a coefficient that adjusts weighting of the influence onto the subsequent train and the energy saving. The optimum speed profile selector 19A selects a speed profile, in which the evaluation index e3 becomes maximum, as the optimum speed profile. Hence, as $\epsilon$ is being smaller, such a speed profile that does not affect the running of the subsequent train will be preferentially selected. That is to say, as $\epsilon$ is being made smaller, suppression of the influence onto the subsequent train is regarded as important.

In Embodiment 3, the evaluation index may be any one as long as being one that, based on the influence onto the subsequent train and on the energy consumption amount reduction effect, makes a judgment for these comprehensively.

In accordance with the above configuration, it is made possible to create a speed profile, which reduces the energy consumption amount while suppressing the adverse effect onto the subsequent train.

Note that the evaluation index for selecting the optimum speed profile may consider not only the energy consumption amount and the influence onto the subsequent train, but also the riding comfort.

Embodiment 4.

Figure 15:
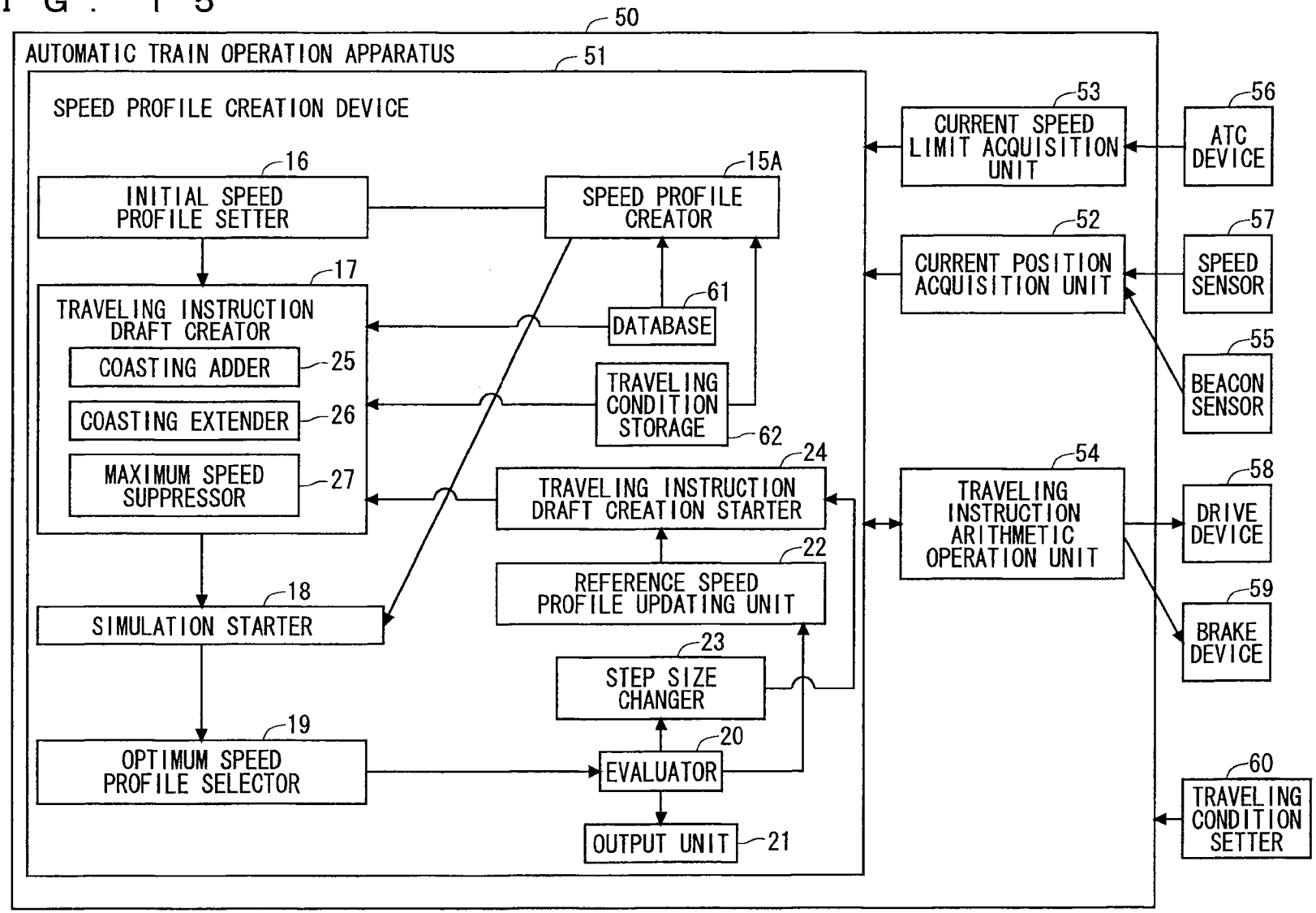
FIG. 15 is a block diagram showing a configuration of an automatic train operation apparatus according to Embodiment 4 of the present invention.

This Embodiment 4 relates to an automatic train operation apparatus that incorporates the speed profile creation device of Embodiment 1 therein. FIG. 15 shows a block diagram showing a configuration of the automatic train operation apparatus according to Embodiment 4 of the present invention.

The automatic train operation apparatus 50 includes: a speed profile creation device 51; a current position acquisition unit 52; a current speed limit acquisition unit 53; and a traveling instruction arithmetic operation unit 54. The automatic train operation apparatus 50 is connected to a beacon sensor 55, an ATC device 56, a speed sensor 57, a drive device 58, a brake device 59, and a traveling condition setter 60.

For convenience of explanation, a description is first made of devices outside the automatic train operation apparatus 50.

The beacon sensor 55 senses a beacon placed on the route, upon passing therethrough, and from the beacon, acquires position information about that point. The ATC device 56 acquires the speed limit of the section from the ground side, and automatically makes deceleration in the case where the train speed exceeds the speed limit. The speed sensor 57 is a device that detects the speed of the train. The drive device 58 is a device that generates power necessary for the train to accelerate or travel at a constant speed. The brake device 59 is a device for decelerating the train.

The traveling condition setter 60 has a function to set such traveling conditions as the target traveling time between the stations of the route and the temporarily set speed limit, and to input the traveling conditions to the speed profile creation device 51. These traveling conditions may be set by a train driver, or may be set from a ground system or another system on the train through a communication device that is not included in this configuration diagram.

Next, a description is made of an inside of the automatic train operation apparatus 50.

In a portion of the speed profile creation device 51, a description is only made of different portions from FIG. 1. A database 61 holds: the route conditions such as the gradients, the positions of the curves, the curvature radii thereof, and the speed limits; and the train performance such as the train weight, the train length, the acceleration performance, the deceleration performance, the air resistance, and the motor efficiency. The traveling condition storage 62 holds the traveling conditions as the data such as the information regarding the start point and end point of the traveling section as the objective section for which the speed profile is to be created, regarding the target traveling time between both of the points, and regarding the temporal speed limits set in the traveling section. One, in which the database 61 and the traveling condition storage 62 are combined with each other, corresponds to the storage 14 in the case of Embodiment 1. The database 61 and the traveling condition storage 62 are also used in other processing units of the automatic train operation apparatus 50. With reference to the database 61 and the traveling condition storage 62, the speed profile creator 15A creates the speed profile from the traveling instruction by a simulation and the like.

The current position acquisition unit 52 specifies current train position and speed by an integral of the position information obtained from the beacon sensor 55 and the speed information obtained from the speed sensor 57. The current speed limit acquisition unit 53 acquires a current speed limit as a speed limit at that point of time, which is obtained from the ATC device 56.

In usual, the traveling instruction arithmetic operation unit 54 creates the traveling instruction in accordance with the speed profile created in advance. However, in the case where the current speed limit by the ATC is lower than the speed obtained by the speed profile, priority is given to that the current speed limit by the ATC is kept. The created traveling instruction is transmitted to the drive device 58 or the brake device 59, whereby the train travels automatically. In the case where the speed profile created in advance cannot be used, the speed profile creation device 51 is started so as to create a speed profile that satisfies the target traveling time and has a small energy consumption amount in a traveling section determined from the current position and speed of the train.

The traveling section determined from the current position and speed of the train is a traveling section from a point where the train is present after a predetermined time to a predetermined end point. The predetermined time is set at a time longer than the time required for the speed profile creation device 51 to create the speed profile.

As an example of the case where the speed profile created in advance cannot be used, there are: a case where the speed limit by the ATC has become lower than the speed limit at an usual time because of a delay of an preceding train; a case where the train resumes the traveling after stopping at a point that is not a station owing to an accident and the like; and a case where the train travels in a shorter time than usual in order to reduce a delay after the delay occurs.

In accordance with the above configuration, even if there are parameters such as the current position and speed, the target traveling time, and the temporal speed limit, which change dynamically during the traveling, then while coping therewith whenever necessary, and keeping the target traveling time, it is possible to automatically create the speed profile in which the energy consumption amount is small, and is possible for the train to automatically travel in accordance therewith. In this way, train running, in which the energy consumption amount is reduced while keeping the train schedule, can be realized.

Note that, in the above configuration, as the ATC device, the description has been made on the premise of an analog ATC system that transmits the speed limit on an on-rail position thereof; however, a one-step ATC that transmits a stop target position of the train, and the like may be used. In the case where the stop target position is transmitted to the train, the current speed limit acquisition unit 53 calculates an upper limit speed, at which the train can stop before the stop target position even if the deceleration is started from the current position, based on brake performance of the train and the route conditions. The current speed limit acquisition unit 53 just needs to use the calculated upper limit speed as the current speed limit.

Note that, for the value to be stored in the database 61 as the train performance information, not the design value but the value assumed based on the traveling history in the past may be used. In this way, the case where the train performance is shifted from the design value and the case where the train performance is varied by the change with time can also be coped with appropriately.

The traveling condition changer is not necessary to be provided. On the contrary, a data changer changing either or both of the route conditions and the train performance, which are stored in the database, may be provided.

The speed profile creation device may be one that considers the riding comfort, and may be any one as long as being one that creates the speed profile, in which the target traveling time is kept, and the train travels through the traveling section with a small energy consumption amount, by changing the speed profile little by little so that the energy consumption amount can decrease though the traveling time is lengthened.

The above matter also applies to other embodiments.

Embodiment 5.

Figure 16:
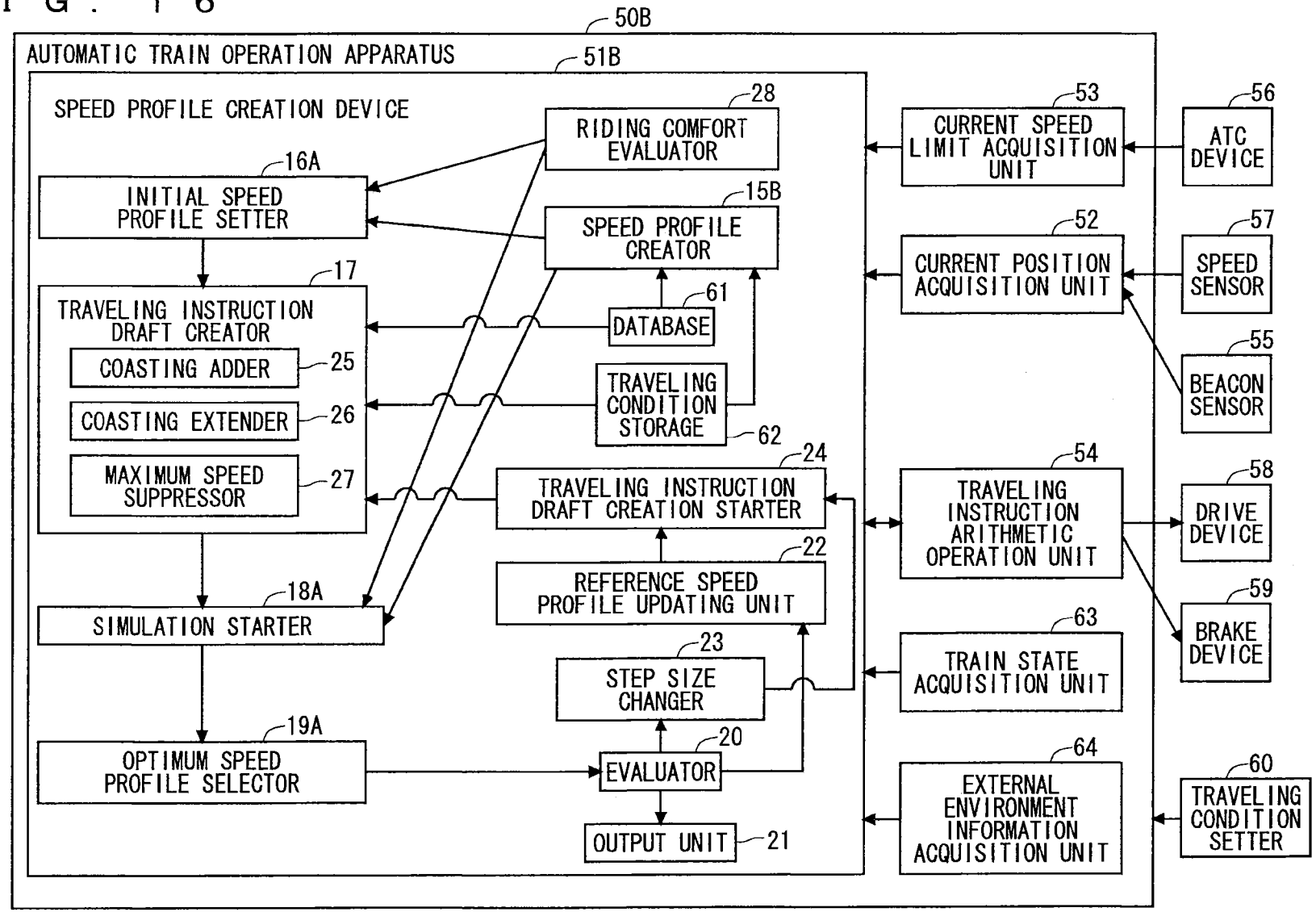
FIG. 16 is a block diagram showing a configuration of an automatic train operation apparatus according to Embodiment 5 of the present invention.

This embodiment is an automatic train operation apparatus, which has the speed profile creation device of Embodiment 2 incorporated therein, and enables the train to travel automatically in consideration of both of the reduction of the energy consumption amount and the riding comfort, and further, also in consideration of a state of the traveling train and external environment information such as weather. FIG. 16 shows a block diagram showing a configuration of the automatic train operation apparatus according to Embodiment 5 of the present invention.

A description is only made of different points in comparison with FIG. 15. An automatic train operation apparatus 50B includes: a train state acquisition unit 63 that acquires a train state such as the vehicle occupancy and a failure of the drive device; and an external environment information acquisition unit 64 that acquires the external environment information such as the weather. The train state and the external environment information, which are acquired, are stored in a traveling condition storage 62B.

A speed profile creation device 51B includes the riding comfort evaluator 28, the initial speed profile setter 16A, the simulation starter 18A and the optimum speed profile selector 19A, which are similar to Embodiment 2. The speed profile creation device 51 further includes a speed profile creator 15B that creates the speed profile also in consideration of the train state and the external environment information.

The speed profile creator 15B obtains the speed profile by using the train performance, which considers the train state, such as changing the acceleration performance and deceleration performance of the train in response to the vehicle occupancy, and using only unbroken-down drive devices in the case where a part of the drive device are broken down. Moreover, the speed profile creator 15 obtains the speed profile also in consideration of the external environment so as to reduce a brake output, and so on in response to the weather in order to avoid an occurrence of slippage between the rails and the wheels, for example, at the time when it rains or when it snows.

In accordance with the above configuration, also in consideration of the train information such as the vehicle occupancy and the external environment information such as the weather, and also in comprehensive consideration of the energy consumption amount reduction effect and the riding comfort while keeping the target traveling time, speed profile is automatically created, and in accordance with that, the train is enabled to travel automatically. In this way, the train running, in which the energy consumption amount is reduced and the riding comfort is good while keeping the train schedule, can be realized.

Only either of the train information acquisition unit and the external environment information acquisition unit may be provided.

Those which have features of the respective embodiments described above in free combination are also incorporated in the present invention.

Although the description has been made of the present invention in detail, the above description is an illustration in all aspects, and the present invention is not limited to this. It is interpreted that unillustrated countless modification examples are imaginable without departing from the scope of the present invention.

EXPLANATION OF REFERENCE NUMERALS

11 route information input unit, 12 train performance input unit, 13 traveling condition input unit, 14 storage, 15 speed profile creator, 15*a* speed profile creator, 15*b* speed profile creator, 16 initial speed profile setter, 16*a* initial speed profile setter, 17 traveling instruction draft creator, 18 simulation starter, 18*a* simulation starter, 19 optimum speed profile selector, 19*a* optimum speed profile selector, 20 evaluator, 21 output unit, 22 reference speed profile updating unit, 23 step size changer, 24 traveling instruction draft creation starter, 25 coasting adder, 26 coasting extender, 27 maximum speed suppressor, 28 riding comfort evaluator, 50 automatic train operation apparatus, 50*b* automatic train operation apparatus, 51 speed profile creation device, 51*b* speed profile creation device, 52 current position acquisition unit, 53 current speed limit acquisition unit, 54 traveling instruction arithmetic operation unit, 55 beacon sensor, 56 ATC device, 57 speed sensor, 58 drive device, 59 brake device, 60 traveling condition setter, 61 database, 62 traveling condition storage, 63 train state acquisition unit, 64 external environment information acquisition unit.

The invention claimed is:

1. A speed profile creation device comprising:

a storage that holds a route condition, train performance, and a traveling condition at least including a traveling section and a target traveling time, the traveling section and the target traveling time being as objects of a speed profile to be created;

a traveling simulator that creates, from a traveling instruction, a speed profile of allowing the train to travel through said traveling section together with a traveling time and energy consumption amount of the speed profile by using the route condition, the train performance, and the traveling condition which are held in said storage;

an initial speed profile setter that sets an initial value for a reference speed profile;

a traveling instruction draft creator that creates, from a reference traveling instruction corresponding to said reference speed profile, a plurality of traveling instruction drafts in which said reference traveling instruction is changed so that the energy consumption amount decreases though the traveling time is lengthened;

a simulation starter that creates, by using said traveling simulator, a plurality of said speed profiles individually corresponding to said plurality of traveling instruction drafts;

an optimum speed profile selector that selects an optimum speed profile as said speed profile, in which an energy consumption amount reduction effect becomes maximum among said plurality of speed profiles created by the simulation starter with respect to said reference speed profile;

an evaluator that determines whether or not a traveling time with said optimum speed profile is in a predetermined time range including said target traveling time;

an output unit that, where the traveling time is in said predetermined time range, outputs either one or both of said optimum speed profile and a traveling instruction corresponding to said optimum speed profile;

a reference speed profile updating unit that sets said optimum speed profile as said reference speed profile where the traveling time of said optimum speed profile is smaller than a lower limit value of said predetermined time range; and a traveling instruction draft creation starter that starts said traveling instruction draft creator where said reference speed profile is set.

2. The speed profile creation device according to claim 1, wherein said traveling instruction draft creator includes: a coasting adder that adds a coasting section to said reference traveling instruction; a coasting extender that lengthens a coasting section; and a maximum speed suppressor that lowers a maximum speed of a section.

3. The speed profile creation device according to claim 2, wherein the coasting section is set in a section having a downward gradient in which an absolute value of the gradient is equal to or more than a predetermined value, the section being located on this side and the other side of an end point of an acceleration section, or on this side of a deceleration section.

4. The speed profile creation device according to claim 2, wherein said maximum speed suppressor lowers a maximum speed in a section in which the maximum speed is higher than in sections adjacent the section.

5. The speed profile creation device according to claim 1, further comprising:

a step size changer that changes a step size for determining a magnitude of a change where said traveling instruction draft creator changes said reference traveling instruction to create said traveling instruction draft, wherein, where the traveling time with said optimum speed profile is larger than the upper limit value of said predetermined time range, said reference speed profile updating unit does not update said reference speed profile, said step size changer changes said step size to be small, and said traveling instruction draft creator is started.

6. The speed profile creation device according to claim 1, further comprising:

a step size changer that changes a step size for determining a magnitude of a change where said traveling instruction draft creator changes said reference traveling instruction to create said traveling instruction draft, wherein, in response to a difference between said target traveling time and the traveling time with said optimum speed profile, said step size changer changes said step size.

7. The speed profile creation device according to claim 1, wherein, by using said traveling simulator, said initial speed profile setter obtains a fastest speed profile of traveling a predetermined traveling section fastest, and sets the fastest speed profile as an initial value of said reference speed profile.

8. The speed profile creation device according to claim 1, further comprising:

a riding comfort evaluator that evaluates riding comfort of said speed profile, and creates a riding comfort index value as an index value thereof, wherein said optimum speed profile selector selects said optimum speed profile based on an energy consumption amount reduction effect for said reference speed profile and on said riding comfort index value.

9. The speed profile creation device according to claim 1, wherein said optimum speed profile selector preferentially selects a speed profile that does not affect running of a train subsequent to a train as the object for which the speed profile is to be created.

10. The speed profile creation device according to claim 1, further comprising:

an input unit that inputs or changes at least any of the route condition, the train performance and the traveling condition.

11. An automatic train operation apparatus comprising:

a speed profile creation device comprising:

a storage that holds a route condition, train performance, and a traveling condition at least including a traveling section and a target traveling time, the traveling section and the target traveling time being as objects of a speed profile to be created;

a traveling simulator that creates, from a traveling instruction, a speed profile of allowing the train to travel through said traveling section together with a traveling time and energy consumption amount of the speed profile by using the route condition, the train performance, and the traveling condition which are held in said storage;

an initial speed profile setter that sets an initial value for a reference speed profile;

a traveling instruction draft creator that creates, from a reference traveling instruction corresponding to said reference speed profile, a plurality of traveling instruction drafts in which said reference traveling instruction is changed so that the energy consumption amount decreases though the traveling time is lengthened;

a simulation starter that creates, by using said traveling simulator, a plurality of said speed profiles individually corresponding to said plurality of traveling instruction drafts:

an optimum speed profile selector that selects an optimum speed profile as said speed profile, in which an energy consumption amount reduction effect becomes maximum among said plurality of speed profiles created by the simulation starter with respect to said reference speed profile;

an evaluator that determines whether or not a traveling time with said optimum speed profile is in a predetermined time range including said target traveling time;

an output unit that, where the traveling time is in said predetermined time range, outputs either one or both of said optimum speed profile and a traveling instruction corresponding to said optimum speed profile;

a reference speed profile updating unit that sets said optimum speed profile as said reference speed profile where the traveling time of said optimum speed profile is smaller than a lower limit value of said predetermined time range, and a traveling instruction draft creation starter that starts said traveling instruction draft creator where said reference speed profile is set;

a current position acquisition unit that specifies current train position and speed;

a current speed limit acquisition unit that acquires a current speed limit as a speed limit at present from an ATC device; and a traveling instruction arithmetic operation unit that, for said traveling condition in which a traveling section determined from the current train position is set, starts said speed profile creation device, and creates a traveling instruction to allow the train to travel in accordance with the created speed profile and said current speed limit.

12. The automatic train operation apparatus according to claim 11, further comprising a train state acquisition unit hat acquires a train state as a state of the train, wherein said speed profile creation device creates said speed profile in consideration of said train state.

13. The automatic train operation apparatus according to claim 11, further comprising an external environment information acquisition unit that acquires external environment information as information regarding an external environment of the train, wherein said speed profile creation device creates said speed profile in consideration of said external environment information.

* * * * *